US009102045B2

(12) United States Patent
Jagdale et al.

(10) Patent No.: US 9,102,045 B2
(45) Date of Patent: Aug. 11, 2015

(54) SYSTEM AND METHOD FOR EASY REMOVAL OF HYDRAULIC HAMMER BUSHING

(75) Inventors: Rakesh Dushyantrao Jagdale, Waco, TX (US); Lauritz P. Pillers, II, McGregor, TX (US)

(73) Assignee: Caterpillar Inc., Peoria, IL (US)

( * ) Notice: Subject to any disclaimer, the term of this patent is extended or adjusted under 35 U.S.C. 154(b) by 809 days.

(21) Appl. No.: 13/248,563

(22) Filed: Sep. 29, 2011

(65) Prior Publication Data

US 2013/0081837 A1 Apr. 4, 2013

(51) Int. Cl.

| | |
|---|---|
| ***B25D 17/08*** | (2006.01) |
| ***B25D 17/26*** | (2006.01) |
| ***E02D 7/18*** | (2006.01) |

(52) U.S. Cl.

CPC ..... *B25D 17/08* (2013.01); *B25D 17/088* (2013.01); *B25D 17/26* (2013.01); *E02D 7/18* (2013.01); *Y10T 29/49815* (2015.01)

(58) Field of Classification Search

CPC ..... B25D 17/00; B25D 17/06; B25D 17/08; B25D 17/088; B25D 17/10; B25D 17/14; B25D 17/26; E02F 3/36; E02D 7/04; E02D 7/10; E02D 13/01

USPC ..... 173/29, 53, 55, 90, 91, 128, 132, 104, 173/109, 114, 171; 279/19.3, 19.5, 52, 47, 279/56

See application file for complete search history.

(56) References Cited

U.S. PATENT DOCUMENTS

| | | | | |
|---|---|---|---|---|
| 2,512,149 | A * | 6/1950 | Gartin | 279/19.5 |
| 3,383,946 | A * | 5/1968 | Justman | 175/320 |
| 3,451,686 | A | 6/1969 | Hammomd | |
| 3,810,641 | A * | 5/1974 | Benjamin | 279/51 |
| 3,894,743 | A * | 7/1975 | Hiroumi | 279/47 |
| 4,657,088 | A | 4/1987 | Grossmann et al. | |
| 4,906,049 | A | 3/1990 | Anderson | |
| 5,522,605 | A * | 6/1996 | Lewis et al. | 279/49 |
| 5,873,579 | A * | 2/1999 | Prokop et al. | 279/19 |
| 5,944,118 | A | 8/1999 | Johansson et al. | |
| 6,224,306 | B1 * | 5/2001 | Hiroumi et al. | 409/234 |
| 6,328,116 | B1 | 12/2001 | Hurskainen et al. | |
| 6,510,904 | B1 | 1/2003 | Tyrrell | |
| 7,152,692 | B2 * | 12/2006 | Hurskainen et al. | 173/16 |
| 7,328,753 | B2 * | 2/2008 | Henriksson et al. | 173/9 |
| 7,364,168 | B2 * | 4/2008 | Comarmond | 279/19.3 |
| 7,661,484 | B2 | 2/2010 | Berger et al. | |
| 7,832,495 | B2 | 11/2010 | Pillers, II | |
| 8,561,690 | B2 * | 10/2013 | Hazelip | 166/208 |
| 2005/0158135 | A1 * | 7/2005 | Massa et al. | 409/234 |
| 2010/0326688 | A1 | 12/2010 | Ullrich et al. | |

FOREIGN PATENT DOCUMENTS

| | | |
|---|---|---|
| CN | 1447731 | 10/2003 |
| CN | 201015863 | 2/2008 |

(Continued)

*Primary Examiner* — Scott A. Smith

(74) *Attorney, Agent, or Firm* — Miller, Matthias & Hull LLP

(57) ABSTRACT

A hydraulic hammer having a front head and a lower bushing is disclosed. Also disclosed is a system and method for easily removing the lower bushing from the front head. The front head of the hydraulic hammer may define a bore therein and an inner surface of the bore may have a first taper. The lower bushing of the hydraulic hammer may be capable of being positioned within the bore of the front head and an outer surface of the lower bushing may have a second taper, with the first taper substantially following the second taper.

14 Claims, 6 Drawing Sheets

(56) References Cited

FOREIGN PATENT DOCUMENTS

| | | |
|---|---|---|
| EP | 0263982 | 4/1988 |
| FR | 766865 | 7/1934 |
| FR | 1121935 | 12/1954 |
| FR | 1134431 | 4/1957 |
| WO | 2006033504 | 3/2006 |

* cited by examiner

| Taper Bushing | |
|---|---|
| Bushing movement from initial position | Clearance |
| 52 0" | 54 0.1 mm |
| 56 1" | 0.25 mm |
| 58 2" | 0.5 mm |
| 60 3" | 0.75 mm |
| 62 4" | 1 mm |

Initial position

48

50

Fig. 4A

| Cylindrical Bushing | |
|---|---|
| Bushing movement from initial position | Clearance |
| 0" | 68 0.1 mm |
| 1" | 70 0.1 mm |
| 2" | 72 0.1 mm |
| 3" | 74 0.1 mm |
| 4" | 76 0.1 mm |

64

66

Fig. 4B
(Prior Art)

SYSTEM AND METHOD FOR EASY REMOVAL OF HYDRAULIC HAMMER BUSHING

TECHNICAL FIELD OF THE DISCLOSURE

The present disclosure relates to hydraulic hammers and, more particularly, relates to a system and method for easy removal of lower bushings of hydraulic hammers.

BACKGROUND OF THE DISCLOSURE

Hydraulic hammers are widely used on work sites to break up or demolish large hard objects, such as, rocks, concrete, asphalt, frozen ground, etc., before such objects can be moved away. Hydraulic hammers can be mounted to work machines like back hoes or excavators, or they can be hand-held. In operation, high pressure fluid drives a piston of the hydraulic hammer to strike a work tool, such as a tool bit, which then strikes the hard object to be broken.

Generally speaking, the work tool is retained within a lower and an upper bushing of the hydraulic hammer, and the upper and the lower bushings in turn are enclosed within a bore of a sleeve or housing, also commonly referred to as a front head. Because of repeated impact of the work tool on hard objects, the lower bushing of the hydraulic hammer experiences extreme loads during operation. Such extreme loads often cause the lower bushing to wear out. As such, the lower bushing may need to be replaced or serviced several times during the product life of the hydraulic hammer. In order to remove the lower bushing from the front head, a cross pin connecting the front head and the lower bushing together may be detached and, the lower bushing may be pulled or pushed out from the front head for replacement or for servicing.

Conventionally, the outer surface of the lower bushing and an inner surface of the bore of the front head are designed parallel to each other such that when the lower bushing is pushed (or pulled) out for removal from the front head, the clearance between the lower bushing and the front head remains the same until the lower bushing is completely removed from the front head bore. As this clearance is small, contact between the lower bushing and the front head may occur, thereby making the removal of the lower bushing difficult. In certain instances, the lower bushing may change its shape during usage, causing the surfaces of the lower bushing and the front head to bind during removal, thereby exacerbating the removal process of the lower bushing. This difficulty in removing the lower bushing from the front head not only increases the servicing time of the lower bushing, it also adds to the labor cost and may even corrode the front head somewhat, which in turn may lead to replacement of the hydraulic hammer altogether.

It would accordingly be beneficial if an improved mechanism for effectively removing the lower bushing from the front head were developed. It would additionally be beneficial if such a mechanism avoided contact between the front head and the lower bushing during removal.

SUMMARY OF THE DISCLOSURE

In accordance with one aspect of the present disclosure, a hydraulic hammer is disclosed. The hydraulic hammer may include a front head defining a bore therein, an inner surface of the bore having a first taper and, a lower bushing capable of being positioned within the bore, an outer surface of the lower bushing having a second taper, the first taper substantially following the second taper.

In accordance with another aspect of the present disclosure, a lower bushing is disclosed. The lower bushing may include an outer wall and an inner wall. The inner wall may define a bore therein and the outer wall may have a tapered surface such that the outer wall and the inner wall are non-parallel to one another.

In accordance with yet another aspect of the present disclosure, a method of removing a lower bushing from a front head of a hydraulic hammer is disclosed. The method may include providing (a) a front head defining a bore therein, the bore having an inner surface with a first taper; and (b) a lower bushing capable of being positioned within the bore, the lower bushing having an outer surface with a second taper and, the inner surface of the bore and the outer surface of the lower bushing defining a clearance therebetween, the clearance remaining constant in an installed state of the lower bushing. The method may also include removing the lower bushing from the front head by increasing the clearance as the lower bushing extends out of the front head.

BRIEF DESCRIPTION OF THE DRAWINGS

FIGS. 4A and 4B are tabular illustrations indicating exemplary clearance measurements between the front head and the lower bushing as the lower bushing is removed from the front head;

While the present disclosure is susceptible to various modifications and alternative constructions, certain illustrative embodiments thereof, will be shown and described below in detail. It should be understood, however, that there is no intention to be limited to the specific embodiments disclosed, but on the contrary, the intention is to cover all modifications, alternative constructions, and equivalents along within the spirit and scope of the present disclosure.

DETAILED DESCRIPTION OF THE DISCLOSURE

Figure 1:
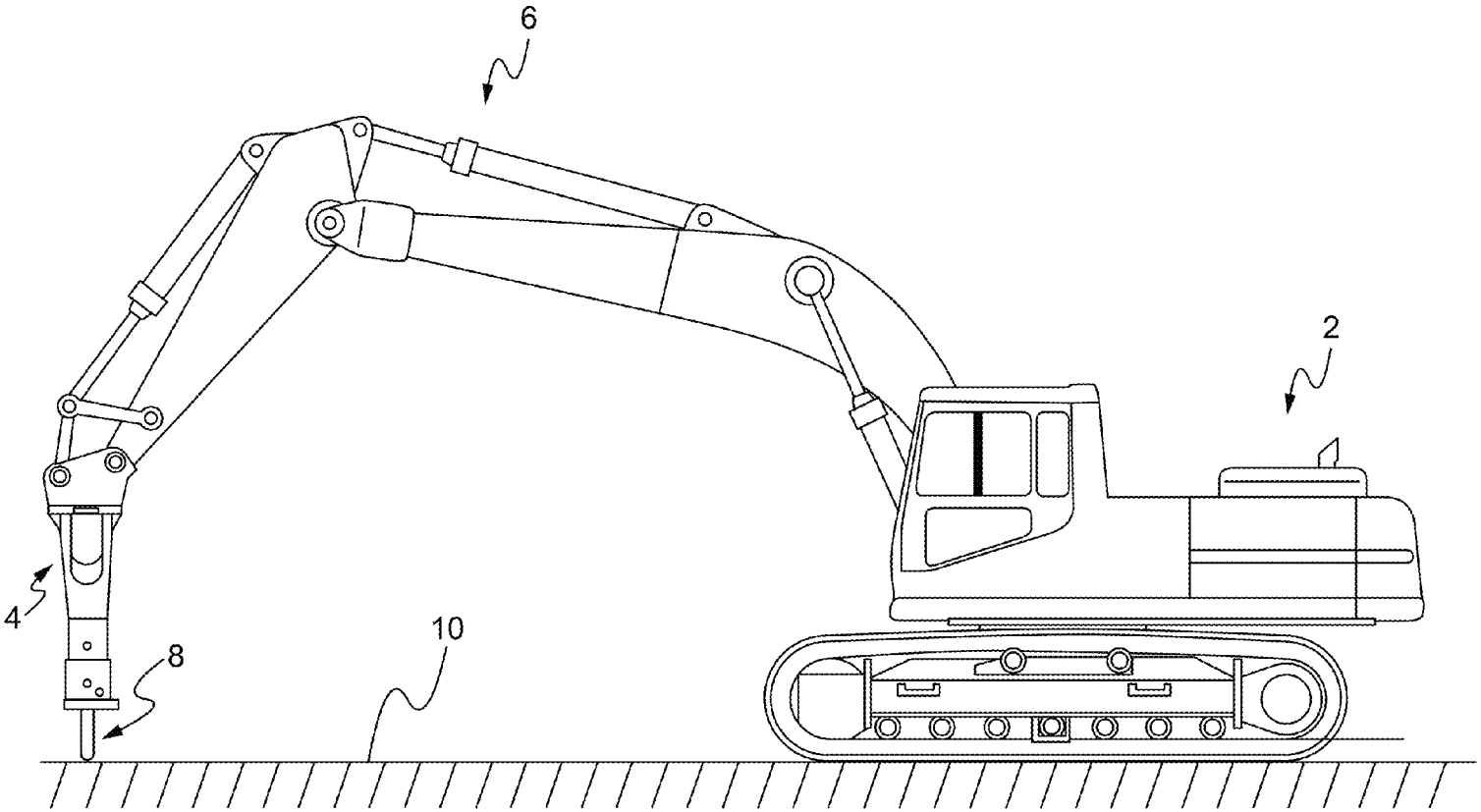
FIG. 1 is an exemplary schematic illustration of a hydraulic hammer attached to a work machine, in accordance with at least some embodiments of the present disclosure.

The present disclosure provides a system and method to effectively remove a lower bushing from a front head of a hydraulic hammer. In this respect and referring to FIG. 1, an exemplary work machine 2 is schematically shown in accordance with at least some embodiments of the present disclosure. A hydraulic hammer 4 may be attached to a boom 6 of the work machine 2 to operate the hammer. A work tool 8, such as, a tool bit, may in turn be attached to the hydraulic hammer 4 for impacting a surface (or an object on surface) 10. In at least some embodiments, the work machine 2 may be an excavator, although in other embodiments, the work machine may be a back loader, a mini excavator, a skid steer or any other type of work machine suitable for attaching and using the hydraulic hammer 4. In at least some other embodiments, the hydraulic hammer 4 may not be attached to the work machine 2 and rather, may be a hand-held device or may be connected to some other suitable base. Furthermore, the hydraulic hammer 4 may be powered by a pneumatic or a hydraulic fluid source, although other types of demolition hammers powered by other types of sources may be employed as well.

It will be understood that only those components that are essential for a proper understanding of the present disclosure are shown and/or described herein. Nevertheless, several other components that are commonly employed in combination or conjunction with the work machine 2 and the hydraulic hammer 4 are contemplated and considered within the scope of the present disclosure.

Figure 2:
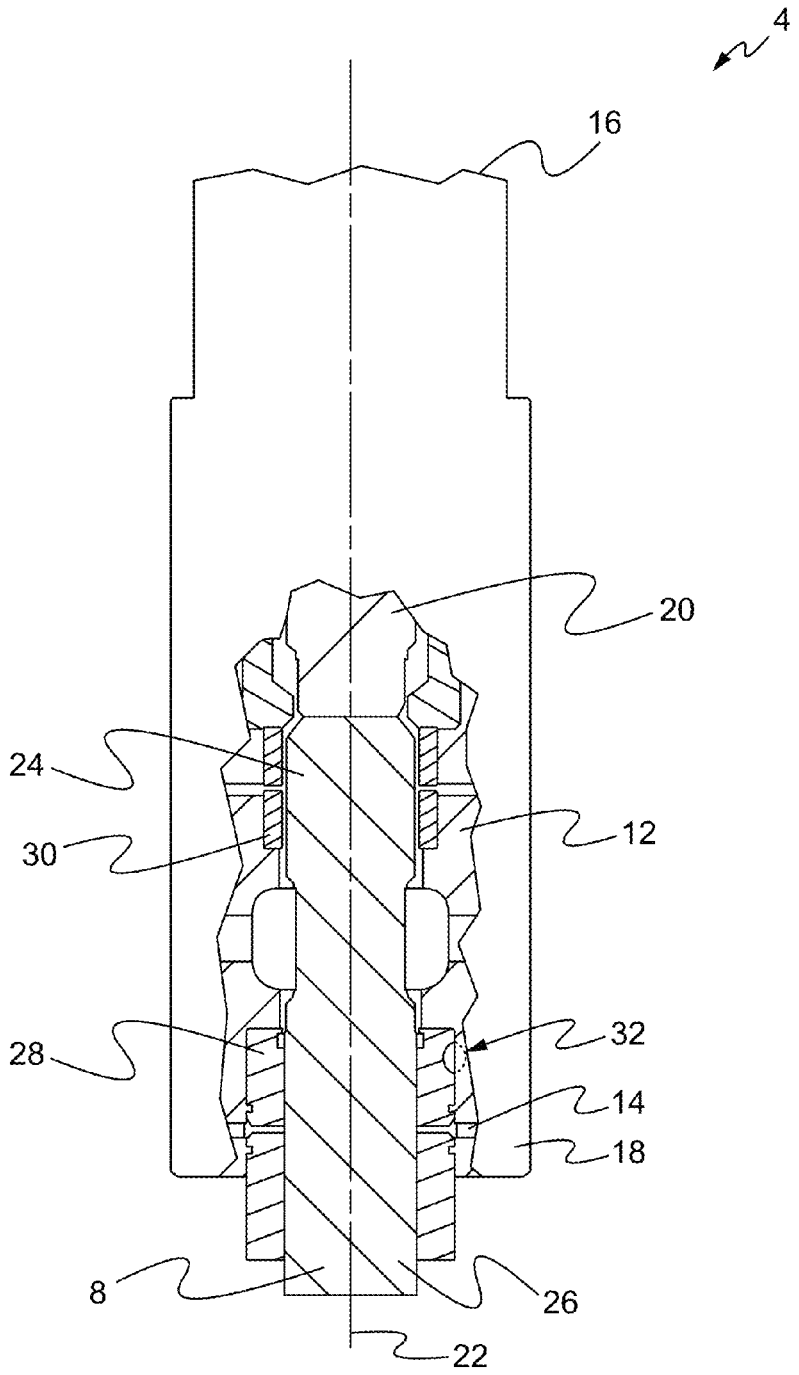
FIG. 2 is a cross-sectional view, in cut-away, of the hydraulic hammer of FIG. 1, in accordance with at least some embodiments of the present disclosure.

Turning now to FIG. 2, a partial cross-sectional view of the hydraulic hammer 4 is shown, in accordance with at least some embodiments of the present disclosure. As shown, the hydraulic hammer 4 may include a housing or front head 12 defining a chamber or bore 14. In at least some embodiments, the front head 12 may include an upper end 16 and a bottom end 18. Furthermore, the front head 12 may be configured or constructed as a single integral piece or may be formed of multiple pieces connected together in operational association. Within the bore 14, a piston 20 may be operatively disposed to translate along an axis 22 to drive the work tool 8. Specifically, the work tool 8 may have a first end 24 that may be configured and positioned within the front head 12 to be struck by the piston 20 and, a second end 26 that may extend from the bottom end 18 of the font head to impact the surface 10 or objects positioned thereon. Particularly, the work tool 8 may be positioned and slidably retained within a lower bushing 28 and an upper bushing 30, both of which may be fixably held within the front head 12. The lower bushing 28 may be connected to the front head 12 by way of one or more cross pins 32. The lower bushing 28 is described in greater detail below with respect to FIGS. 6A-6D.

Notwithstanding the components of the hydraulic hammer 4 described above, it will be understood that several other components that have not been described, such as, various pins and retainers for retaining the upper bushing 30 and the work tool 8 within the front head 12 and for connecting those components relative to one another and the lower bushing 28, various sealing rings, etc. are contemplated and considered within the scope of the present disclosure.

Figures 3A, 3B, 3C:
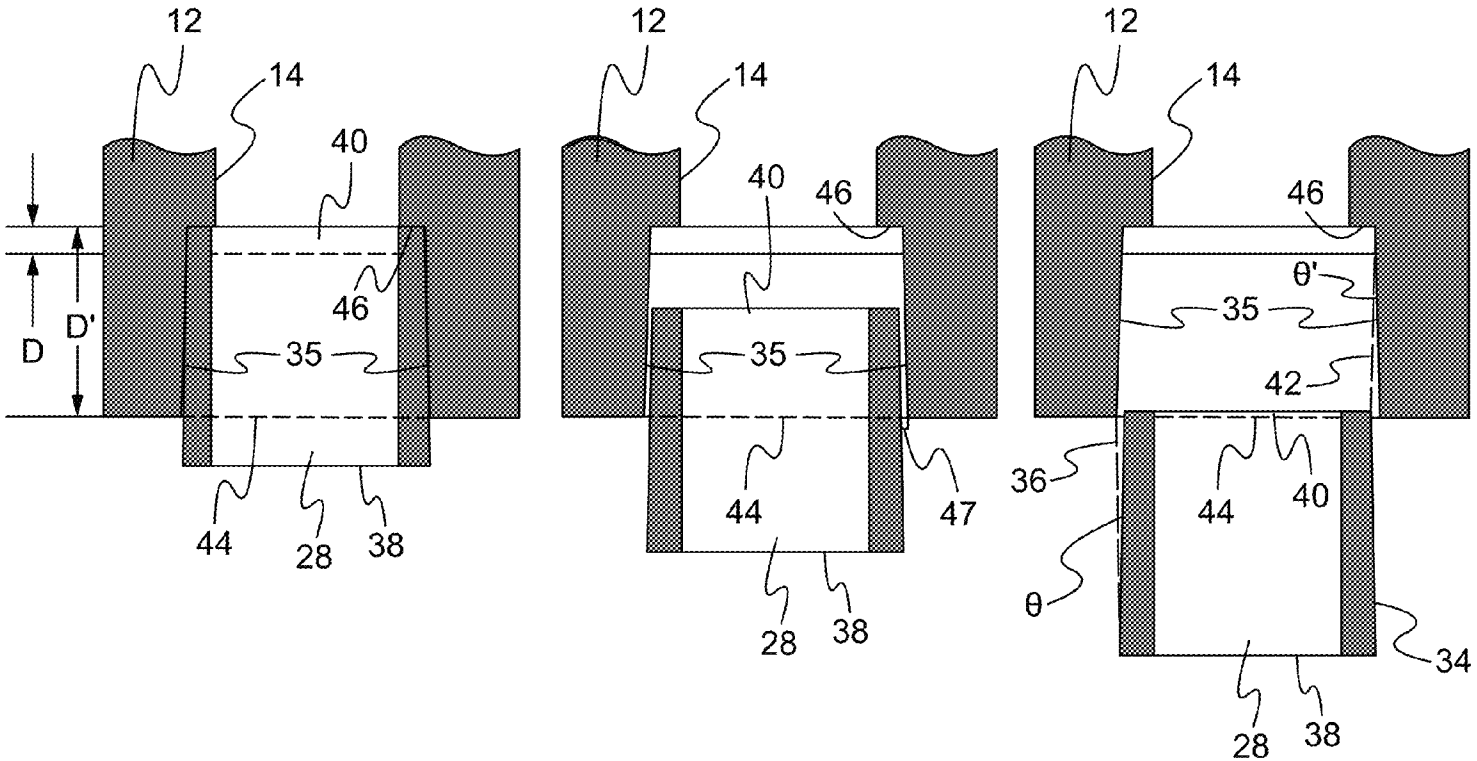
FIGS. 3A-3C are schematic illustrations, in cut-away, of a lower bushing and a front head of the hydraulic hammer of FIG. 1 illustrating removal of the lower bushing with respect to the front head, in accordance with at least some embodiments of the present disclosure.

Referring now to FIGS. 3A-3C, schematic illustrations of the front head 12 and the lower bushing 28 are shown, in accordance with at least some embodiments of the present disclosure. Specifically, each of the FIGS. 3A-3C show various stages of removal of the lower bushing 28 relative to the front head 12. More specifically, FIG. 3A shows the lower bushing 28 in an installed position within the front head 12, while FIG. 3B shows the lower bushing partially removed from the front head and FIG. 3C shows the lower bushing completely removed from the front head.

In order to facilitate an effective removal of the lower bushing 28 from the front head 12, each of the lower bushing 28 and the front head 12 may be provided with a tapered surface. With respect to the lower bushing 28 in particular, an outer surface (or wall) 34 of the lower bushing may be tapered (e.g., have a conical or substantially conical surface) and the tapering may extend along an entire (or substantially entire) length of the lower bushing. In at least some embodiments, the outer surface 34 may be tapered by an angle Θ (See. FIG. 3C) of about half a degree to about one degree with respect to a vertical surface or line 36. In other embodiments, the degree (e.g., angle Θ) of tapering of the outer surface 34 of the lower bushing 28 may vary. Thus, due to the tapered outer surface 34, the lower bushing 28 may have a broader bottom portion 38 and a narrower top portion 40 for facilitating removal (e.g., by pulling from the bottom or pushing from the top) of the lower bushing from the bottom of the front head 12. It will be understood that in at least some embodiments, the lower bushing 28 may be removed (e.g., by pulling from the top or pushing from the bottom) from a top portion of the front head 12 in which case, the lower bushing may have a broader top portion 40 and a narrower bottom portion 38.

Furthermore, the tapered lower bushing 28 may be tightly held and fitted within the similarly tapered bore 14 of the front head 12. Specifically, the length of the bore 14 of the front head 12 that may be in contact with the outer surface 34 of the lower bushing 28 during a normal installed state may be tapered in at least some embodiments. The degree of tapering of the bore 14 may be similar to the degree of tapering of the outer surface 34 of the lower bushing 28. Thus, in at least some embodiments, the bore 14 and, particularly, an inner surface 35 of the bore, may be tapered by an angle Θ' of about half a degree to about one degree relative to a vertical surface or line 42 and may have a broader bottom bore portion 44 and a narrower top bore portion 46 to mimic the broader bottom portion 38 and the narrower top portion 40, respectively, of the lower bushing 28.

By virtue of designing the lower bushing 28 and the bore 14 of the front head 12 with tapered surfaces, easy removal of the lower bushing from the front head may be facilitated. Specifically, due to the tapering of the lower bushing 28 and the front head 12, a clearance (e.g., the gap between the front head and the lower bushing) 47 may increase as the lower bushing is pulled (or pushed) out from the front head for servicing or replacement. This increase in the clearance 47 between the lower bushing 28 and the front head 12 as the lower bushing is removed from the front head may prevent any contact between the lower bushing and the front head even when the shape of the outer surface 34 of the lower bushing changes during usage, thereby making the removal of the lower bushing easy.

Furthermore, during removal of the lower bushing 28 from the front head 12, the lower bushing may only need to be pulled (or pushed) by a small distance D (See. FIG. 3A) from the top bore portion 46 beyond which the clearance 47 between the lower bushing and the front head starts to increase and the lower bushing may be easily removed or may possibly even slide down by itself. This is in contrast to conventional designs where both the lower bushing 28 and the front head 12 have cylindrical parallel surfaces with the clearance 47 being constant, which can result in binding between the lower bushing and the front head and, the distance D may be equal to D', thereby requiring the lower bushing to be pulled (or pushed) through a greater distance making the removal more difficult. Additionally, given that the taper of the outer surface 34 of the lower bushing 28 follows (or substantially follows) the taper of the bore 14, the clearance 47 between the front head 12 and the lower bushing may remain substantially the same through the entire length of the lower bushing during normal installed operation.

Thus, as the lower bushing 28 is removed from the bore 14 of the front head 12, the clearance 47 between the lower bushing and the front head gradually increases. An exemplary increase in the amount of the clearance 47 as the lower bushing 28 is removed from the front head 12 is shown in a tabular form in FIG. 4A. It will be understood that although in the present embodiment, both the front head 12 and the lower bushing 28 have been described as having tapered surfaces, this need not always be the case. Rather, in alternate embodiments, only one of the front head 12 and the lower bushing 28 may be tapered. Furthermore, the degree of taper may vary.

Referring now to FIGS. 4A and 4B, exemplary measurements of the clearance 47 between the front head 12 and the lower bushing 28 as the lower bushing is removed from the front head are shown in tabular form, in accordance with at least some embodiments of the present disclosure. It will be understood that the measurements provided in FIGS. 4A and 4B are merely exemplary and these measurements may vary in other embodiments depending upon several factors, such as, dimensions of the front head 12 and the lower bushing 28, the amount of tapering of the front head and the lower bushing, etc. Furthermore, FIG. 4A shows the clearance measurements between the front head 12 and the lower bushing 28 with tapered surfaces, as described above and, FIG. 4B shows the clearance measurements in a conventional cylindrical lower bushing and front head design.

As shown in FIG. 4A, a left column 48 shows the amount of movement (e.g., the distance D of FIG. 3A) of the lower bushing 28 from the top bore portion 46 of the front head 12 during removal of the lower bushing from an installed position, while a right column 50 shows the amount of increase in the clearance 47 as the lower bushing is removed. Thus, an initial or installed position 52 when the lower bushing 28 is completely installed within the front head 12 shows a movement of about zero inches (0") of the lower bushing relative to the front head and the clearance 47 (shown in block 54) of about a one tenth of a millimeter (0.1 mm). As the lower bushing 28 is removed from the front head 12 by pushing (or pulling) the lower bushing relative to the front head, thereby increasing the distance D from about one inch (1") to about four inches (4"), the clearance 47 between the front head and the lower bushing gradually increases from about one fourth of a millimeter (0.25 mm) to about one millimeter (1 mm), as evidenced by rows 56 through 62, respectively.

These measurements are in contrast to the measurements shown in FIG. 4B in which a left column 64 is identical to the left column 48 of FIG. 4A showing the amount of movement (e.g., the distance D) of the lower bushing 28 from the top bore portion 46 of the front head 12 and, a right column 66 shows the measurements of the clearance 47 between the front head and the lower bushing as the lower bushing is removed further away from the front head. It can be seen that as the lower bushing 28 is removed from the front head 12, thereby increasing the distance D from about zero inches (0") to about four inches (4"), the clearance 47 between the front head and the lower bushing 28 remains the same at about one tenth of a millimeter (0.1 mm), as shown by rows 68-76. Therefore, with no increase in the clearance 47 between the front head 12 and the lower bushing 28, the lower bushing has to be pushed (or pulled) out completely (e.g., with D=D') to remove the lower bushing from the front head in conventional designs, thereby making the removal difficult and time consuming.

Figure 6A:
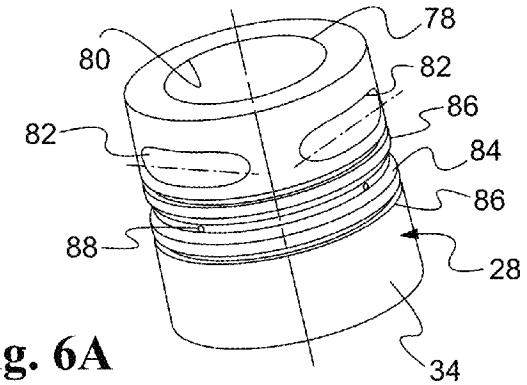
FIG. 6A is a perspective view of an exemplary lower bushing, in accordance with at least some embodiments of the present disclosure.
Figure 6B:
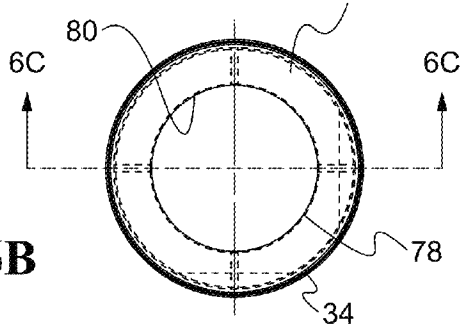
FIG. 6B is a top view of FIG. 6A.
Figure 6C:
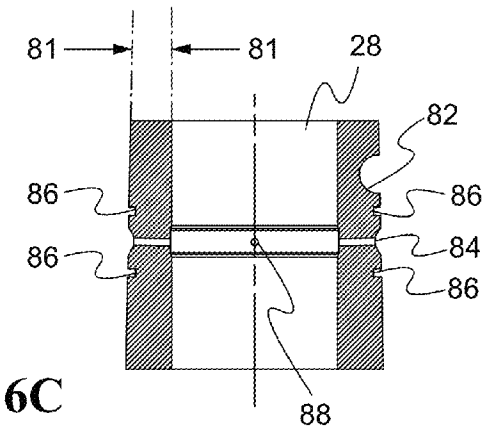
FIG. 6C is a cross-sectional view taken along lines A-A of FIG. 6B.
Figure 6D:
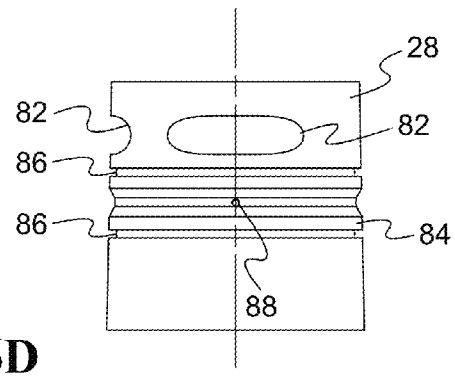
FIG. 6D is a front view of FIG. 6A.

Turning now to FIGS. 6A-6D, an exemplary one of the lower bushing 28 is shown, in accordance with at least some embodiments of the present disclosure. Specifically, FIG. 6A shows a perspective view of the lower bushing 28, while FIG. 6B shows a top view thereof. Relatedly, FIG. 6C shows a cross-sectional view taken along line A-A of FIG. 6B, while FIG. 6D shows a front view of the lower bushing 28. As shown, the lower bushing 28 may be a cylindrical or substantially cylindrical structure capable of being positioned within the front head 12 and further capable of receiving and securing the work tool 8 for operation.

In particular, the lower bushing 28 may include the outer wall 34 and an inner wall 78, the inner wall defining a bore 80 within which the work tool 8 may be received and secured. Furthermore, as described above, and as clearly shown in FIG. 6C, the outer wall 34 of the lower bushing 28 may be tapered, while the inner wall 78 need not be tapered (e.g., vertical). Thus, the outer and the inner walls 34 and 78, respectively, may be non-parallel to one another, as shown by arrows 81. As mentioned above, the outer wall 34 may be tapered to mimic a taper in the bore 14 of the front head 12 for facilitating an easy removal of the lower bushing 28 therefrom.

Additionally, the outer wall 34 may include a plurality of elongated recesses 82, positioned at (or substantially at) ninety degrees to one another. Any one of the recesses 82 may be employed for inserting the cross-pins 32 to secure the lower bushing 28 to the front head 12. Typically, only one of the cross-pins 32, and thus, only one of the recesses 82 is used for securing the front head 12 and the lower bushing 28. However, since wear on the inner surface (e.g., the inner wall 78) of the lower bushing 28 may not be even (the front and the back inner surfaces may wear more than the side surfaces, or vice-versa), the lower bushing may be rotated by ninety degrees (and the recess 82 at that ninety degree angle may be used to secure the front head 12 and the lower bushing) to extend the operating life of the lower bushing before replacement may be needed.

The outer wall 34 may further include one or more chamfered or circumferential grooves 84 flanked on either sides by additional grooves (e.g., square grooves) 86. The chamfered grooves 84 may be employed for receiving lubricant from the front head 12 and for supplying that lubricant (e.g., grease) to lubricate the surface between the inner wall 78 and the work tool 8. Specifically, the lubricant received from the front head 12 may fill around the chamfered grooves 84 and may then flow to the surface of the inner wall 78 by way of a plurality (e.g., four apertures) of apertures 88. The additional grooves 86 may be employed for holding sealing mechanisms (such as, O-rings) for containing the lubricant within the chamfered grooves 84, thereby preventing the lubricant from flowing along the outer wall 34 of the lower bushing 28.

Notwithstanding the features of the lower bushing 28 described above with respect to FIGS. 6A-6D, it will be understood that other features that are commonly provided in lower bushings and specifically for lower bushings for use with hydraulic hammers, are intended and considered within the scope of the present disclosure.

INDUSTRIAL APPLICABILITY

In general, the present disclosure sets forth a system and method for easily removing a lower bushing from a front head of a hydraulic hammer for replacement or servicing. One or both of the front head and the lower bushing may have a tapered or otherwise conical (or substantially conical and tapered) configuration. Specifically, an outer surface of the lower bushing may be tapered and an inner bore surface of the front head may be tapered as well mimicking the taper of the lower bushing. A method of removing the lower bushing from the front head is shown in the flowchart of FIG. 5.

Figure 5:
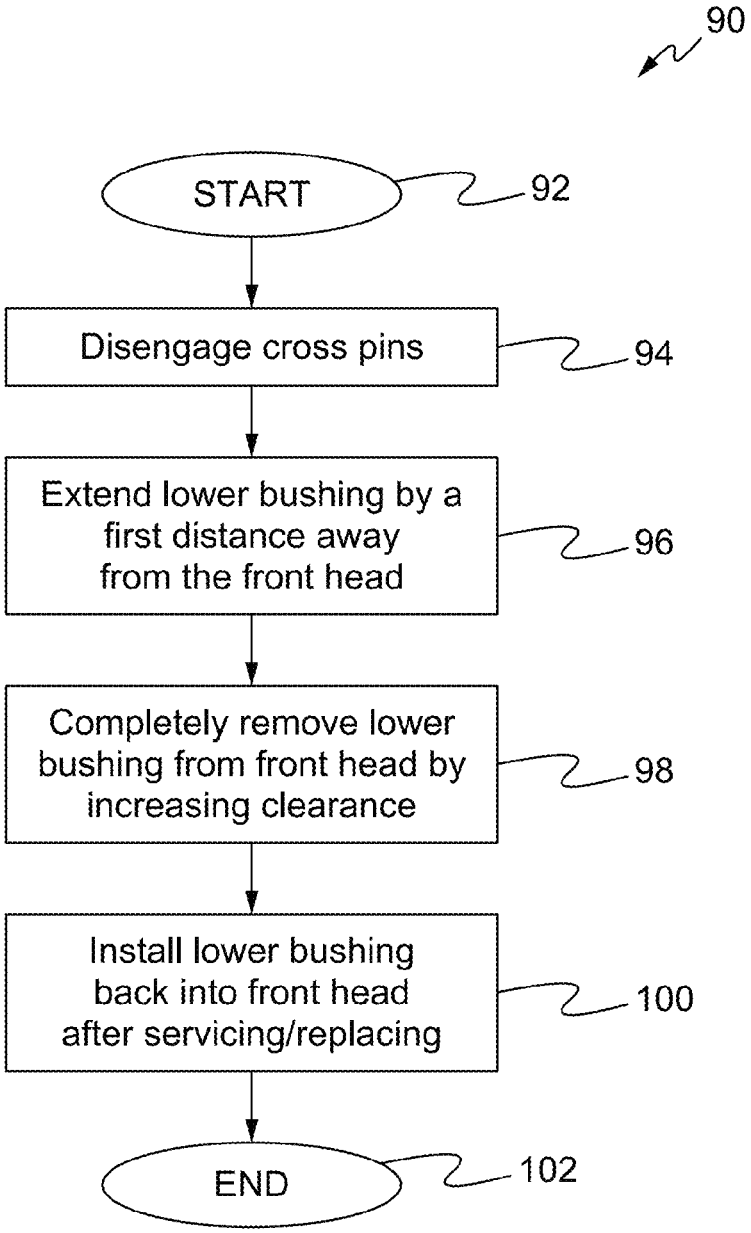
FIG. 5 is an exemplary flowchart outlining the steps for removing the lower bushing from the front head of the hydraulic hammer.

Referring to FIG. 5, a flowchart 90 outlining the steps of removal of the lower bushing 28 from the front head 12 is shown, in accordance with at least some embodiments of the present disclosure. As shown, after starting at a step 92, the cross-pins 32 connecting the lower bushing 28 to the front head 12 may first be removed at a step 94. Next, at a step 96, the lower bushing 28 may be extended by a first distance (equal to the distance D of FIG. 3A) out of the front head to facilitate removal of the lower bushing. Then, at a step 98, the lower bushing 28 may be further extended away from the front head 12, such that beyond the first distance, the clearance between the front head and the lower bushing increases to facilitate an easy removal of the lower bushing from the front head. In at least some embodiments, after removing the lower bushing 28 from the front head 12 by the first distance, the lower bushing may even slide out of the front head by itself. Subsequent to removing the lower bushing 28, it may be replaced or otherwise serviced in a manner deemed appropriate and may be installed back into the front head, as illustrated by step 100. The process then ends at a step 102.

By virtue of providing the tapered surfaces of the lower bushing and the front head bore, and by mimicking the tapering of those surfaces, the clearance between those surfaces remain the same as the conventional design during a working assembly, and the clearance increases only as the lower bushing is pushed out for replacement or servicing, thereby making the removal of the lower bushing easy. Easing the removal of the lower bushing not only saves time and labor cost, it also prevents the inadvertent damage of the front head (that may occur due to binding of the front head and the lower bushing), thereby preventing a complete replacement of the hydraulic hammer.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A hydraulic hammer, comprising:

a front head defining a first bore therein, an inner surface of the first bore having a first taper;

a lower bushing capable of being positioned within the first bore, an outer surface of the lower bushing having a second taper, the first taper substantially following the second taper, an inner wall of the lower bushing defining a second bore, and a clearance between the inner surface of the front head and the outer surface of the lower bushing that exists when the lower bushing is in an installed state within the front head; and a work tool positioned and slidably retained within the second bore for repetitive axial movement along an axis of the hydraulic hammer during operation of the hydraulic hammer.

2. The hydraulic hammer of claim 1, wherein the clearance between the front head and the lower bushing stays constant in the installed state of the lower bushing.

3. The hydraulic hammer of claim 1, wherein the clearance between the front head and the lower bushing increases as the lower bushing is removed from the front head.

4. The hydraulic hammer of claim 3, wherein the clearance increases from about one tenth of a millimeter when the bushing is in an installed position to about one millimeter when the bushing is removed axially from the installed position by approximately 4".

5. The hydraulic hammer of claim 1, wherein the first taper ranges from about half a degree to about one degree from a vertical line.

6. The hydraulic hammer of claim 1, wherein the second taper ranges from about half a degree to about one degree from a vertical line.

7. The hydraulic hammer of claim 1, wherein the lower bushing has a broader bottom portion and a narrower top portion.

8. The hydraulic hammer of claim 1, wherein the first bore has a broader bottom bore portion and a narrower top bore portion.

9. The hydraulic hammer of claim 1, wherein the lower bushing is tapered along a substantially entire length thereof.

10. The hydraulic hammer of claim 9, wherein the first bore is tapered along the substantial entire length of the lower bushing.

11. The hydraulic hammer of claim 1, wherein the first taper and the second taper prevent binding of the lower bushing to the front head during removal.

12. A hydraulic hammer, comprising:

a front head defining a first bore therein, an inner wall of the first bore having a first tapered surface;

a lower bushing capable of being positioned within the first bore, an outer wall of the lower bushing having a second tapered surface, the first tapered surface substantially following the second tapered surface, an inner wall of the lower bushing defining a second bore such that the inner and outer walls of the lower bushing are non-parallel to one another, and a clearance between the inner wall of the front head and the outer wall of the lower bushing exists when the lower bushing is in an installed state within the front head; and a work tool positioned and slidably retained within the second bore for repetitive axial movement along an axis of the hydraulic hammer during operation of the hydraulic hammer, and wherein the outer wall includes a plurality of elongated recesses perpendicular to a longitudinal axis of the lower bushing and positioned substantially at ninety degrees to one another.

13. The lower bushing of claim 12 further having a narrower top portion and a broader bottom portion.

14. The lower bushing of claim 12, wherein the outer wall further includes a plurality of annular grooves, and a plurality of apertures extending radially through the lower bushing from the outer wall to the inner wall, for lubricating a work tool disposed and slidable within the bore defined by the inner wall.

* * * * *